US007530488B2

(12) United States Patent
Salerno et al.

(10) Patent No.: US 7,530,488 B2
(45) Date of Patent: May 12, 2009

(54) DOUBLE POSTCARD INTERMEDIATE

(75) Inventors: John Salerno, Charlotte, NC (US); Carey Daniel, Pinson, AL (US)

(73) Assignee: The Standard Register Company, Dayton, OH (US)

( * ) Notice: Subject to any disclaimer, the term of this patent is extended or adjusted under 35 U.S.C. 154(b) by 764 days.

(21) Appl. No.: 11/041,473

(22) Filed: Jan. 24, 2005

(65) Prior Publication Data

US 2005/0103830 A1 May 19, 2005

(51) Int. Cl.
*B42D 15/02* (2006.01)

(52) U.S. Cl. ..... 229/92.8; 229/92.1; 229/300; 229/316

(58) Field of Classification Search ..... 229/92.8, 229/92, 300, 316, 92.1, 92.3
See application file for complete search history.

(56) References Cited

U.S. PATENT DOCUMENTS 2,168,920 A * 8/1939 Wiasmann ..... 229/92.8
4,102,489 A * 7/1978 Lucas ..... 229/304
4,898,323 A * 2/1990 Chen et al. ..... 229/92.3
4,936,769 A * 6/1990 Schoenleber ..... 229/92.1
5,062,570 A * 11/1991 Ashby ..... 229/71
5,427,851 A 6/1995 Mehta
5,458,273 A * 10/1995 Schubert et al. ..... 229/304
5,667,134 A 9/1997 Olson et al.
7,090,114 B1 * 8/2006 Katz ..... 229/92.8
2002/0036151 A1 * 3/2002 Deiger ..... 206/449
2002/0195484 A1 * 12/2002 Rawlings et al. ..... 229/305

* cited by examiner

*Primary Examiner*—Nathan J Newhouse
*Assistant Examiner*—Jack H Morgan, Jr.
(74) *Attorney, Agent, or Firm*—Dinsmore & Shohl LLP

(57) ABSTRACT

A mailer intermediate includes a generally rectangular sheet of printable, postcard stock having first and second side edges, first and second end edges, and first and second faces. A fold line extends substantially transverse to the side edges and substantially bisects them, whereby the sheet is divided by the fold line into first and second postcard portions. An adhesive pattern is provided on the first face of the sheet, adjacent at least one of the first and second end edges, for securing the first and second postcard portions together adjacent the first and second end edges. Adhesive patterns on the first face of the sheet adjacent the first and second side edges are provided only near the fold line, whereby the first face of the first and second postcard portions are not adhered together along a substantial majority of the extent of the first and second side edges of the first and second postcard portions. The fold line may be defined by a line of weakness, such as for example a perforation line. Additionally, the sheet may have additional perforation lines that define marginal portions in which the adhesive is positioned. These marginal portions can be torn from the mailer by the recipient, permitting the mailer to be opened.

34 Claims, 5 Drawing Sheets

DOUBLE POSTCARD INTERMEDIATE

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION

The invention is directed to a V-Folded double postcard that contains variable information inside, yet qualifies for postcard postal rates. Double postcards have been in use for a number of years. Such a double postcard is shown in U.S. Pat. No. 5,667,134, issued Sep. 16, 1997 to Olsen et al., and assigned to Moore Business Forms. The '134 patent teaches a V-fold double postcard that includes a negotiable check on one of the two postcard panels. The two postcard panels are held together at the end edges by adhesive patterns, and along the lateral edges by small adhesive spots. While providing privacy, the postcard of the '134 patent no longer complies with postal regulations and it can no longer be mailed at the postcard rate.

Effective Feb. 5, 2004, the U.S. Postal Service revised its *Domestic Mail Manual* (DMM) C100.2.9 to clarify standards governing the content and sealing of double postcards. According to the new standards, only the top or bottom of a double postcard, once folded, may be sealed. Double postcards may not be sealed against inspection and are to be configured so that they can be examined to ensure that the reply half does not include an additional message. Therefore, sealing of the sides of double postcards, regardless of method, is not permitted.

The text of DDM C100.2.9, entitled "Double Cards" is as follows:

A double card (i.e., a double stamped card or double postcard) consists of two attached cards, one of which is designed to be detached by the recipient and returned by mail as a single card. Double cards are subject to these standards:

a. The reply half of a double card must be used for reply only and may not be used to convey a message to the original addressee or to send statements of account. The reply half may be formatted for response purposes (e.g., contain blocks for completion by the addressee).
b. A double card must be folded before mailing and prepared so that the address on the reply half is on the inside when the double card is originally mailed. The address side of the reply half may be prepared as business reply mail, courtesy reply mail, meter reply mail, or as a merchandise return service label.
c. Plain stickers, seals, or a single wire stitch (staple) may be used to fasten the open edge at the top or bottom once the card is folded if affixed so that the inner surfaces of the cards can be readily examined. Fasteners must be affixed according to the applicable preparation requirements for the rate claimed. Any sealing on the left and right sides of the cards, no matter the sealing process used, is not permitted.
d. The first half of a double card must be detached when the reply half is mailed for return. (emphasis added).

One difficulty caused by compliance with the DDM is that the double postcard is not easily handled after printing, folding in a V-fold, and then sealing along the end edges. If the side edges, which are not sealed together so as to permit inspection for compliance with postal regulations, should separate and form a gap, the folded double postcard may jam automated mail handling and sorting equipment. It is seen that there is a need, therefore, for a double postcard construction, that complies with postal regulations, that has a reduced tendency to separate along lateral edges, and that has a reduced likelihood of jamming automated mail handling equipment.

SUMMARY OF THE INVENTION

This need is met by a mailer intermediate that can be folded into postcard size according to the present invention. The intermediate includes a generally rectangular sheet of printable, postcard stock having first and second side edges, first and second end edges, and first and second faces. A fold line extends substantially transverse to the side edges and substantially bisects them, whereby the sheet is divided by the fold line into first and second postcard portions. An adhesive pattern is provided on the first face of the sheet, adjacent at least one of the first and second end edges, for securing the first and second postcard portions together adjacent the first and second end edges. Adhesive patterns on the first face of the sheet adjacent the first and second side edges are provided only near the fold line, whereby the first face is not adhered together along a substantial majority of the extent of the first and second side edges of the first and second postcard portions. The fold line may be defined by a line of weakness, such as for example a perforation line.

The adhesive patterns adjacent the first and second side edges may be comprised of a remoist adhesive. Alternatively, the adhesive patterns adjacent the first and second side edges may be comprised of a pressure sensitive adhesive. Further, the adhesive patterns adjacent the first and second side edges may be comprised of a pressure sensitive cohesive. The adhesive pattern adjacent at least one of the first and second end edges may comprise a pressure sensitive cohesive. This cohesive may be provided in complementary patterns on the first face of the sheet adjacent both the first and second end edges. These complementary patterns may include a large pattern of pressure sensitive cohesive adjacent one of the first and second end edges and a smaller pattern of pressure sensitive cohesive adjacent the other of the first and second end edges, with the patterns overlapping when the mailer is folded along the fold line.

The adhesive patterns adjacent the first and second side edges may comprise complementary patterns of pressure sensitive cohesive on the first face of the sheet adjacent both the first and second side edges near the fold line. By this arrangement, the first faces of the first and second postcard portions are not adhered together along a substantial majority of the extent of the first and second side edges of the first and second postcard portions.

The sheet of postcard stock is dimensioned so that when it is folded about the fold line, the resulting mailer has postcard size dimensions. The outgoing addressee indicia may be imaged on the second face of the first postcard portion of the sheet, and return addressee indicia may be imaged on the first face of the second postcard portion of the sheet.

First and second perforation lines may be provided in the sheet adjacent and parallel to the first and second side edges, respectively. The first perforation line and the first side edge define a first marginal portion therebetween, and the second perforation line and the second side edge define a second marginal portion therebetween. Adhesive patterns may be provided on the first face of the sheet in the marginal portions only near the fold line. The first face of the first and second portions are not adhered together along a substantial majority of the extent of the first and second side edges of the first and second portions.

The generally rectangular sheet of printable stock may comprise a sheet of 38# postal ledger stock, a sheet of 65# cover stock, a sheet of 90# index stock, a sheet of 100# tab card stock, a sheet of 100# tag stock, a sheet of 110# index stock, or a sheet of 125# tag stock.

Third and fourth perforation lines may be provided in the sheet adjacent and parallel to the first and second end edges, respectively. The third perforation line and the first end edge define a third marginal portion therebetween. The fourth perforation line and the second end edge define a fourth marginal portion therebetween. The adhesive pattern on the first face of the sheet, adjacent at least one of the first and second end edges, may be positioned in at least one of the third and fourth marginal portions. This adhesive pattern may comprise a remoist adhesive, a pressure sensitive adhesive, or a pressure sensitive cohesive.

The pressure sensitive cohesive pattern on the first face of the sheet in at least one of the third and fourth marginal portions may comprise a pressure sensitive cohesive in both the third and the fourth marginal portions. These complementary patterns may include a large pattern of pressure sensitive cohesive adjacent one of the first and second end edges, and a smaller pattern of pressure sensitive cohesive adjacent the other of the first and second end edges.

It is an object of the present invention to provide a mailer intermediate that is foldable into postcard size, that qualifies for postcard postal rates, and that does not jam mail handling and sorting equipment.

Other objects and advantages of the invention will be apparent from the following description, the accompanying drawings, and the appended claims.

DETAILED DESCRIPTION OF THE PREFERRED EMBODIMENTS

Figure 1:
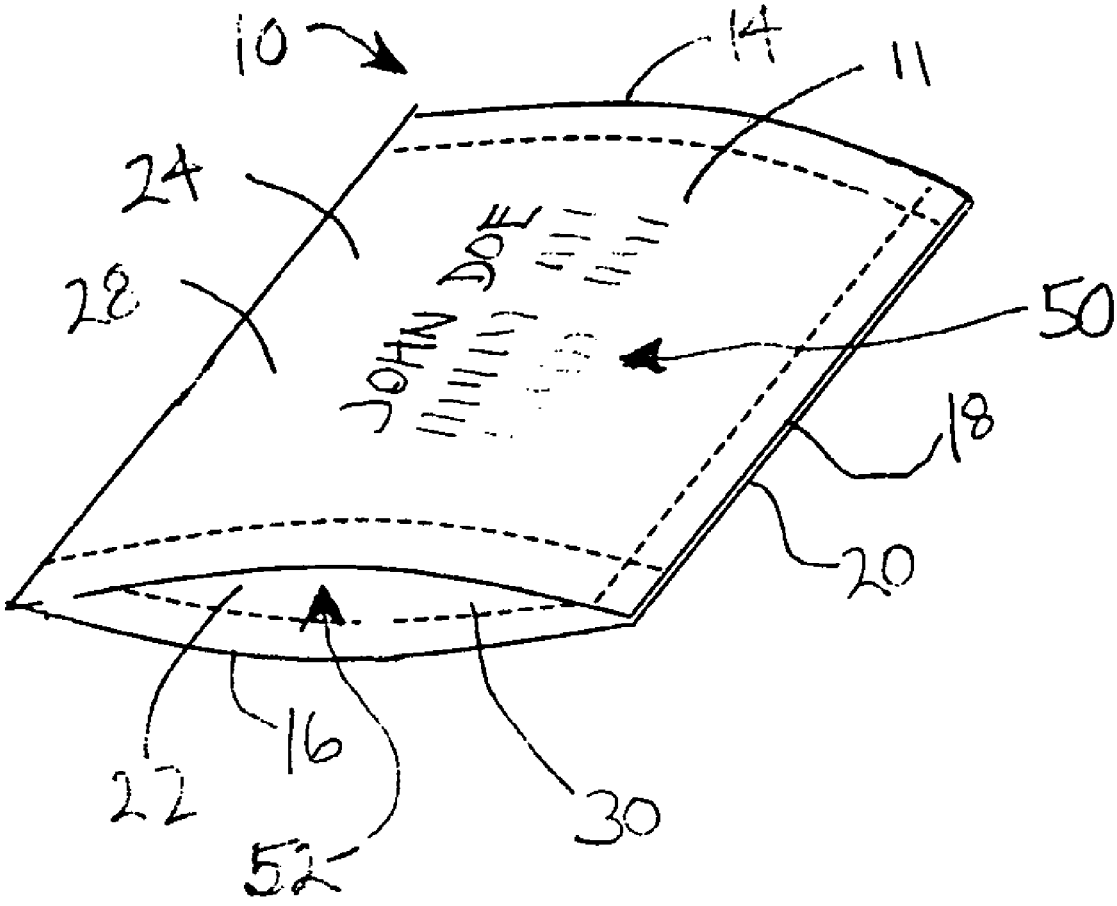
FIG. 1 is a perspective view of a V-folded, double postcard, exhibiting a gap between the mailer panels of the type that the present invention is intended to correct.
Figure 2:
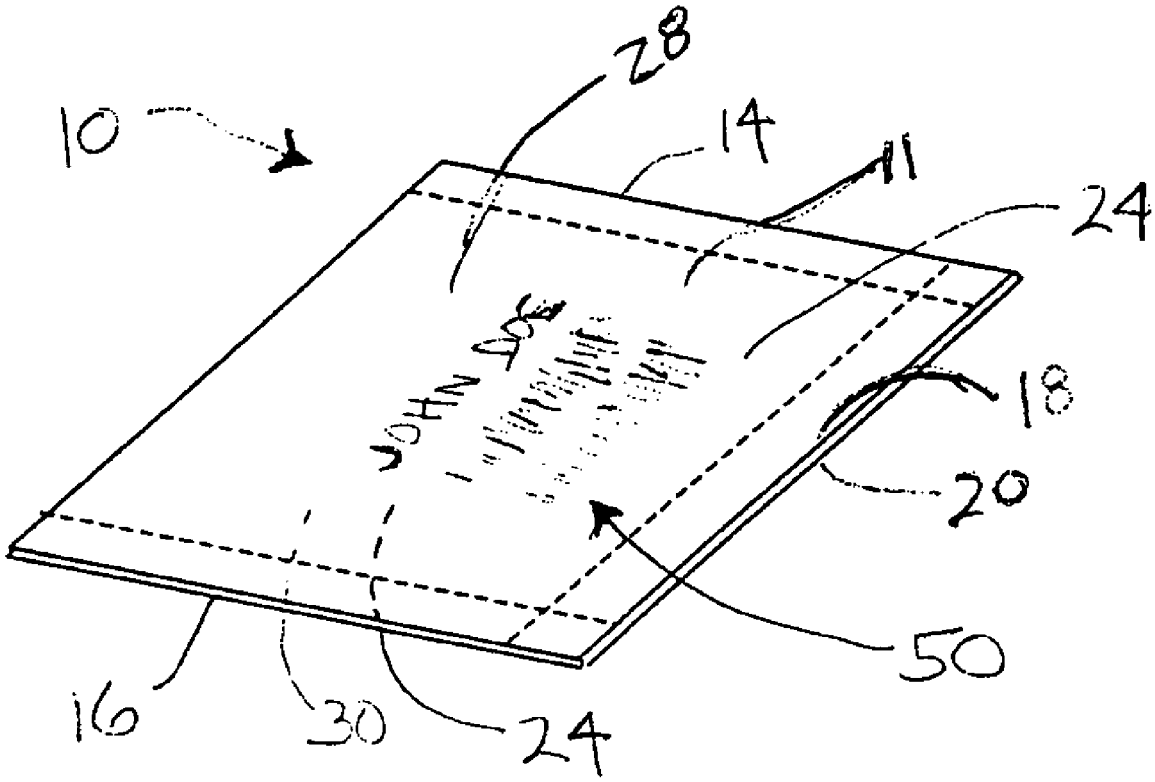
FIG. 2 is a perspective view of a V-folded double postcard in which there is no gap between the panels.
Figure 3:
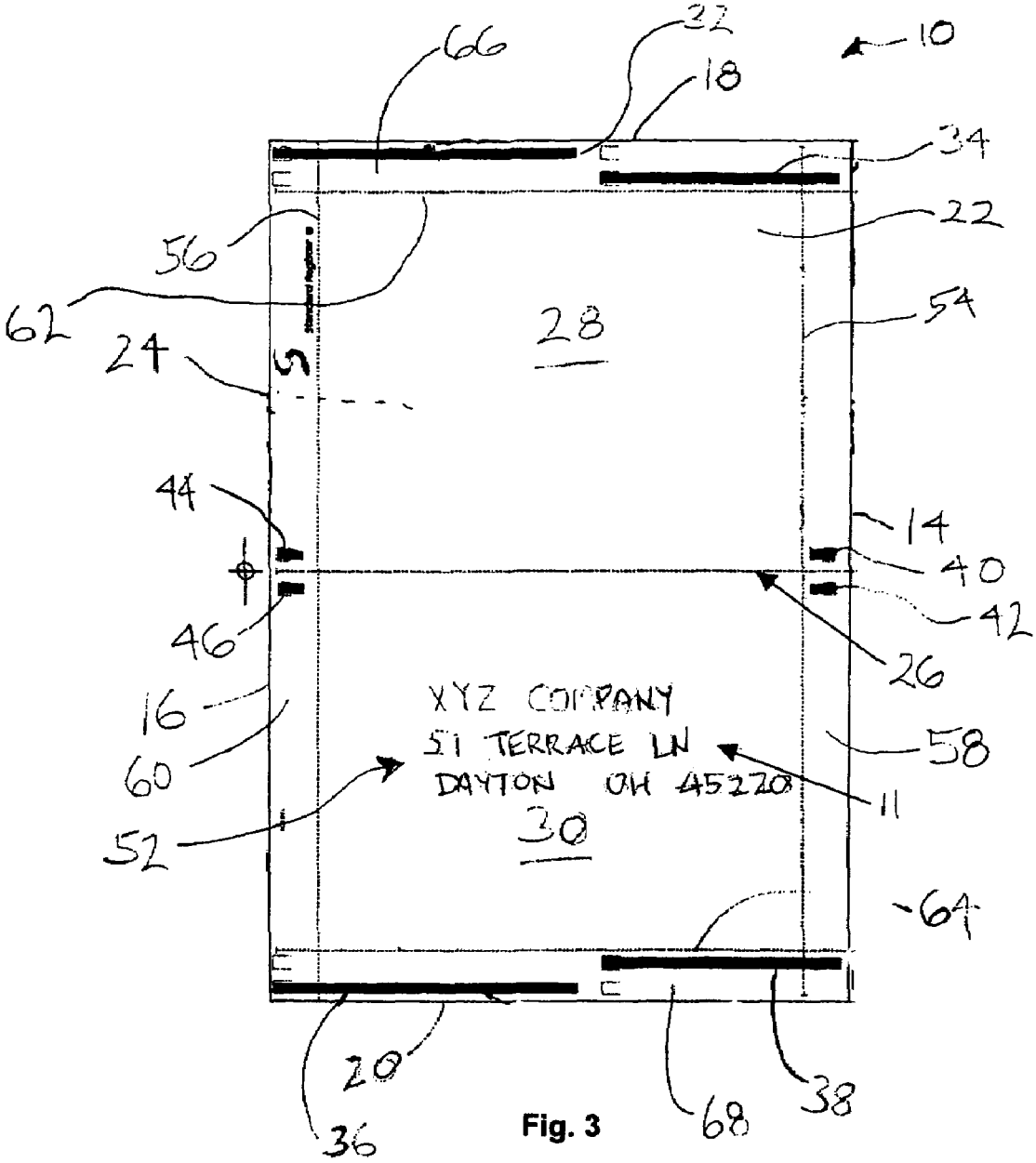
FIG. 3 is a plan view of the mailer intermediate of the present invention.

Reference is made to FIG. 3 of the drawings showing a mailer intermediate 10 that is constructed in accordance with the present invention. The mailer intermediate may be folded into postcard size, as depicted in FIGS. 1 and 2.

As discussed above, the postcard mailer of the present invention is intended to qualify for postcard postal rates. Postal regulations require that double postcards of this type may not be sealed against inspection. Rather, such double postcards must be capable of being examined to insure that the reply half of the postcard does not include an additional message. Therefore, it is necessary that the double post card, when folded and sealed as shown in FIG. 2, still permits postal authorities to inspect the interior faces of the two postcard portions, spreading apart the side edges, as shown in FIG. 1. However, it is also necessary that these side edges typically stay together as shown in FIG. 2 as the postcard passes through the mail system so that it is not mishandled by automated mail sorting and handling equipment. The manner in which this is accomplished by the present invention is explained below.

The mailer intermediate of the present invention includes a generally rectangular sheet 11 of postcard stock having first and second side edges 14 and 16, first and second end edges 18 and 20, and first and second faces 22 and 24.

A fold line 26 extends substantially transverse to the side edges 14 and 16 and substantially bisecting them. The sheet may be folded along the fold line 26 dividing the sheet into first and second postcard portions 28 and 30. The first and second portions 28 and 30 are preferably of substantially the same dimension. An adhesive pattern, including stripes of adhesive 32, 34, 36, and 38, is positioned on the first face 22 of the sheet 11, adjacent at least one of the first and second end edges 18 and 20, securing the first and second postcard portions 28 and 30 together adjacent the first and second end edges 18 and 20.

Additionally, adhesive patterns 40, 42, 44, and 46 are provided on the first face 22 of the sheet 11 adjacent the first and second side edges 14 and 16 only near the fold line 26. The adhesive patterns 40-46 tend to hold the two postcard portions 28 and 30 together in a flat configuration as illustrated in FIG. 2, while at the same time complying with postal regulations. The first face 22 of the first postcard portions 28 and the first face 22 of the second postcard portion 30 are not adhered together along a substantial majority of the extent of the first and second side edges 14 and 16 of the first and second postcard portions 28 and 30, however. The fold line 26 may be defined by a line of weakness, such as for example a perforation line.

The adhesive patterns 40-46 adjacent the first and second side edges may be comprised of a pressure sensitive adhesive, such as for example a pressure sensitive cohesive. With a cohesive, adhesion occurs where pattern 40 contacts pattern 42 and pattern 44 contacts pattern 46. Alternatively, adhesive patterns adjacent the first and second side edges 14 and 16 may be comprised of a remoist adhesive. With remoist adhesive, only one pattern of adhesive is needed adjacent each side edge, as the adhesive will bond to paper after it is moistened and the mailer is folded.

The adhesive patterns 32, 34, 36, and 38 adjacent at least one of the first and second end edges 18 and 20 may comprise a pressure sensitive adhesive, such as a pressure sensitive cohesive. The adhesive pattern on the first face 22 of the sheet 11, adjacent at least one of the first and second end edges 18 and 20, includes complementary patterns on the first face of the sheet adjacent both of the first and second end edges. These complementary patterns are arranged to obtain adhesive-to-adhesive bonding. Alternatively, remoist adhesive or pressure sensitive adhesive may be provided adjacent the first and second end edges 18 and 20. In either case, the adhesive adheres directly to the material of the sheet 11. As a consequence, complementary adhesive patterns are not required to bond the panels 28 and 30 together when using either remoist adhesive or pressure sensitive adhesive.

The sheet 11 of postcard stock is dimensioned so that when it is folded about the fold line 26, the resulting mailer has postcard size dimensions. Prior to folding the sheet 11, both sides of the sheet are printed with information. Outgoing addressee indicia 50 are imaged on the second face 24 of the first postcard portion 28 of the sheet 11. Return addressee indicia 52 are imaged on the first face 22 of the second postcard portion 30 of the sheet 11. Additional information may be printed on the first face 22 of the first postcard portion 28.

In the embodiment of FIGS. 1-3, first and second perforation lines 54 and 56 are provided in the sheet 11 adjacent and parallel to the first and second side edges 14 and 16, respectively. The first perforation line 54 and the first side edge 14 define a first marginal portion 58 therebetween. Similarly, second perforation line 56 and the second side edge 16 define a second marginal portion 60. It will be noted that the adhesive patterns 40-46 are provided in the marginal portions 58 and 60.

The mailer intermediate further includes third and fourth perforation lines 62 and 64 in the sheet 11 adjacent and parallel to the first and second end edges 18 and 20, respectively. The third perforation line 62 and the first end edge 18 define a third marginal portion 66 therebetween. The fourth perforation line 64 and the second end edge 20 define a fourth marginal portion 68 therebetween. The adhesive pattern, including stripes 32-38, on the first face 22 of the sheet 11, is adjacent at least one of the first and second end edges 18 and 20. These adhesive patterns are in at least one of the third and fourth marginal portions. Upon receipt of the postcard, as shown in FIG. 2, the recipient may simply tear off the marginal portions, thereby removing all of the adhesive that previously held the postcard in its folded orientation.

The generally rectangular sheet of printable stock may comprise any suitable material. Examples include 38# postal ledger stock, 65# cover stock, 90# index stock, 100# tab card stock, 100# tag stock, 110# index stock, and 125# tag stock.

Figure 4:
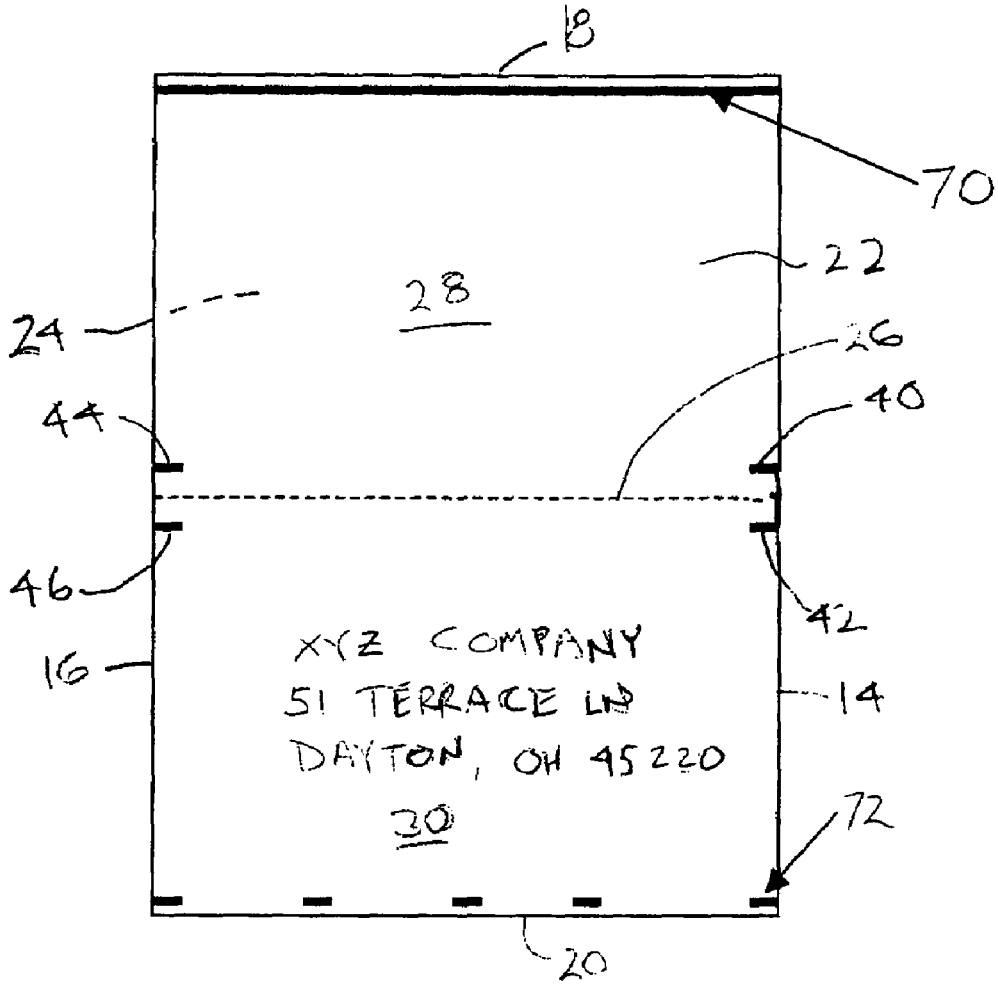
FIG. 4 is a plan view of another embodiment of the present invention.

Reference is made to FIG. 4, which shows another embodiment of the present invention. Elements corresponding to those of the mailer intermediate of FIGS. 1-3 have been labeled with corresponding reference numerals. It will be noted that the embodiment of FIG. 4 does not include removable marginal portions that are stripped away along with the adhesive patterns that seal the mailer. Rather, the embodiment of FIG. 4, includes significantly smaller patterns of pressure sensitive adhesive such that the panels 28 and 30 can be separated simply by pulling them apart. Specifically, the complementary patterns adjacent the end edges 18 and 20 include a large pattern of pressure sensitive cohesive 70 adjacent one of the first and second end edges 18 and 20, and a smaller pattern of pressure sensitive cohesive 72 adjacent the other of the first and second end edges.

It will be appreciated that sealing will be effected in the limited areas in which the small rectangles of cohesive 72 come into contact with the strip 70 of cohesive after folding the mailer. Thus the sealing effect will be limited. By using a larger strip 70, the need for precise location of the cohesive on the sheet 11 is significantly reduced. A lateral misalignment of the small rectangles of cohesive 72 with respect to the large pattern of cohesive 70 will result in no change in the overlap of the patterns 70 and 72, and thus no change in the sealing along the end edges 18 and 20.

Figure 5:
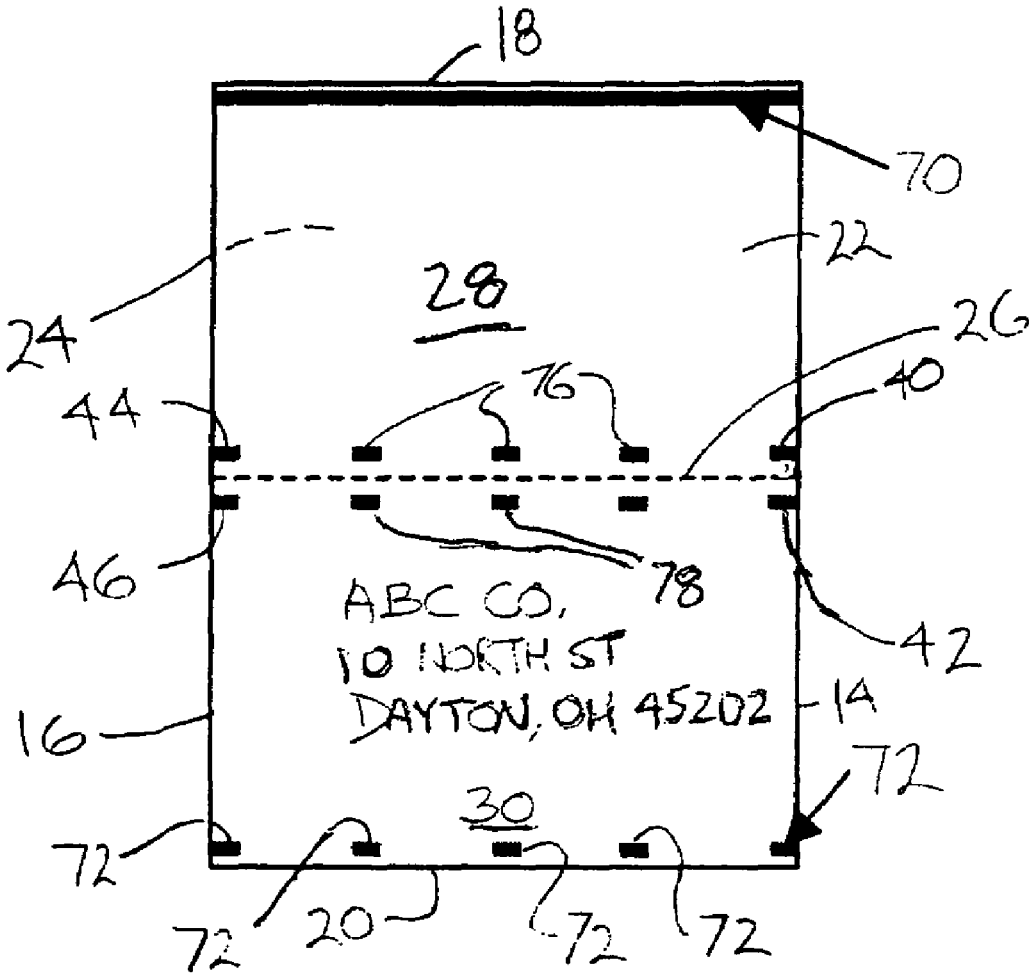
FIG. 5 is a plan view of yet another embodiment of the present invention.

Reference is made to FIG. 5, which shows yet another embodiment of the present invention. Elements corresponding to those of the mailer intermediate of FIG. 4 have been labeled with corresponding reference numerals. It will be noted that the embodiment of FIG. 5, like that of FIG. 4, does not include removable marginal portions, along with the adhesive patterns that seal the mailer. The embodiment of FIG. 5, like that of FIG. 4, includes patterns 70 and 72 of pressure sensitive adhesive that provide little overlap when the mailer intermediate is folded along fold line 26. As a consequence, the panels 28 and 30 can simply be separated by pulling them apart.

In the embodiment of FIG. 5, additional complementary cohesive patterns 76 and 78 are provided on panels 28 and 30 adjacent the fold line 26. Cohesive patterns 76 and 78 assist the adhesive patterns 40-46 in holding the mailer panels 28 and 30 flat and keeping them together so that the information printed on the first surface 22 of the panel 28 is not readily exposed to view when the mailer is folded along fold line 26 and the mailer sealed. However, the first surface 22 of the panel may be inspected to determine compliance with Postal regulations. It should be appreciated that other types of adhesive may be used along the fold line 26 in lieu of cohesive patterns 76 and 78, such as pressure sensitive adhesive and remoist adhesive.

While certain representative embodiments and details have been shown for purposes of illustrating the invention, it will be apparent to those skilled in the art that various changes in the apparatus disclosed herein may be made without departing from the scope of the invention, which is defined in the appended claims.

What is claimed is:

1. A mailer intermediate foldable into postcard size, comprising:

a generally rectangular sheet of postcard stock having first and second side edges, first and second end edges, and first and second faces;

a fold line extending substantially transverse to said side edges and substantially bisecting them, whereby said sheet is divided by said fold line into first and second postcard portions;

an adhesive pattern on said first face of said sheet, adjacent at least one of said first and second end edges, for securing said first and second postcard portions together adjacent said first and second end edges, and adhesive patterns on said first face of said sheet adjacent said first and second side edges only near said fold line, whereby said first face of said first and second postcard portions are not adhered together along a substantial majority of the extent of the first and second side edges of said first and second postcard portions, said adhesive patterns on said first face of said sheet adjacent said first and second side edges only near said fold line being substantially closer to said fold line than to said first or second end edges.

2. The mailer intermediate of claim 1, in which said fold line is defined by a line of weakness.

3. The mailer intermediate of claim 2, in which said fold line is defined by a perforation line.

4. The mailer intermediate of claim 1 in which said adhesive patterns adjacent said first and second side edges are comprised of a remoist adhesive.

5. The mailer intermediate of claim 1 in which said adhesive patterns adjacent said first and second side edges are comprised of a pressure sensitive adhesive.

6. The mailer intermediate of claim 1 in which said adhesive patterns adjacent said first and second side edges are comprised of a pressure sensitive cohesive.

7. The mailer intermediate of claim 1 in which said adhesive pattern adjacent at least one of said first and second end edges comprises a pressure sensitive cohesive, and in which said adhesive pattern on said first face of said sheet, adjacent at least one of said first and second end edges, includes complementary patterns on said first face of said sheet adjacent both of said first and second end edges.

8. The mailer intermediate of claim 7 in which said complementary patterns include a large pattern of pressure sensitive cohesive adjacent one of said first and second end edges and a smaller pattern of pressure sensitive cohesive adjacent the other of said first and second end edges.

9. The mailer intermediate of claim 1 in which said adhesive patterns adjacent said first and second side edges comprise complementary patterns of pressure sensitive cohesive on said first face of said sheet adjacent both of said first and second side edges near said fold line.

10. The mailer intermediate of claim 1 in which said sheet of postcard stock is dimensioned so that when folded about said fold line, the resulting mailer has postcard size dimensions.

11. The mailer intermediate of claim 1 in which outgoing addressee indicia are imaged on said second face of said first postcard portion of said sheet, and in which return addressee indicia are imaged on said first face of said second postcard portion of said sheet.

12. The mailer intermediate of claim 1 further comprising adhesive patterns on said first face of said sheet adjacent said fold line.

13. The mailer intermediate of claim 12 in which said adhesive patterns on said first face of said sheet adjacent said fold line comprise a cohesive.

14. The mailer intermediate of claim 12 in which said adhesive patterns on said first face of said sheet adjacent said fold line comprise a pressure sensitive adhesive.

15. The mailer intermediate of claim 12 in which said adhesive patterns on said first face of said sheet adjacent said fold line comprise a remoist adhesive.

16. A mailer intermediate foldable into postcard size, comprising:

a generally rectangular sheet of printable stock having first and second side edges, first and second end edges, and first and second faces;

a fold line extending substantially transverse to said side edges, dividing said sheet into first and second portions;

first and second perforation lines in said sheet adjacent and parallel to said first and second side edges, respectively, said first perforation line and said first side edge defining a first marginal portion therebetween and said second perforation line and said second side edge defining a second marginal portion therebetween, an adhesive pattern on said first face of said sheet, adjacent at least one of said first and second end edges, for securing said first and second portions together adjacent said first and second end edges, and adhesive patterns on said first face of said sheet in said marginal portions only near said fold line, whereby said first face of said first and second portions are not adhered together along a substantial majority of the extent of the first and second side edges of said first and second portions, said adhesive patterns on said first face of said sheet in said marginal portions only near said fold line being substantially closer to said fold line than to said first or second end edges.

17. The mailer intermediate of claim 16, in which said generally rectangular sheet of printable stock comprises a sheet of 38# postal ledger stock.

18. The mailer intermediate of claim 16, in which said generally rectangular sheet of printable stock comprises a sheet of 65# cover stock.

19. The mailer intermediate of claim 16, in which said generally rectangular sheet of printable stock comprises a sheet of 90# index stock.

20. The mailer intermediate of claim 16, in which said generally rectangular sheet of printable stock comprises a sheet of 100# tab card stock.

21. The mailer intermediate of claim 16, in which said generally rectangular sheet of printable stock comprises a sheet of 100# tag stock.

22. The mailer intermediate of claim 16, in which said generally rectangular sheet of printable stock comprises a sheet of 110# index stock.

23. The mailer intermediate of claim 16, in which said generally rectangular sheet of printable stock comprises a sheet of 125# tag stock.

24. The mailer intermediate of claim 16, further comprising third and fourth perforation lines in said sheet adjacent and parallel to said first and second end edges, respectively, said third perforation line and said first end edge defining a third marginal portion therebetween, and said fourth perforation line and said second end edge defining a fourth marginal portion therebetween.

25. The mailer intermediate of claim 24 in which said adhesive pattern on said first face of said sheet, adjacent at least one of said first and second end edges, comprises an adhesive pattern on said first face of said sheet in at least one of said third and fourth marginal portions.

26. The mailer intermediate of claim 25 in which said adhesive pattern on said first face of said sheet in at least one of said third and fourth marginal portions comprises a remoist adhesive.

27. The mailer intermediate of claim 25 in which said adhesive pattern on said first face of said sheet in at least one of said third and fourth marginal portions comprises a pressure sensitive adhesive.

28. The mailer intermediate of claim 25 in which said adhesive pattern on said first face of said sheet in at least one of said third and fourth marginal portions comprises a pressure sensitive cohesive.

29. The mailer intermediate of claim 25 in which said adhesive pattern on said first face of said sheet in at least one of said third and fourth marginal portions comprises a pressure sensitive cohesive, and in which said adhesive pattern on said first face of said sheet includes complementary patterns on said first face of said sheet in both said third and said fourth marginal portions.

30. The mailer intermediate of claim 29 in which said complementary patterns include a large pattern of pressure sensitive cohesive adjacent one of said first and second end edges and a smaller pattern of pressure sensitive cohesive adjacent the other of said first and second end edges.

31. The mailer intermediate of claim 16, in which said fold line is defined by a line of weakness.

32. The mailer intermediate of claim 16, in which said fold line is defined by a perforation line.

33. The mailer intermediate of claim 16 in which said sheet of printable stock is dimensioned so that when folded about said fold line, the resulting mailer has postcard size dimensions.

34. The mailer intermediate of claim 16 in which said first and second portions are of substantially the same dimensions.

* * * * *